United States Patent [19]

Strong

[11] Patent Number: 4,909,173

[45] Date of Patent: Mar. 20, 1990

[54] SCRUBBING DEVICE FOR SUBMERGED SURFACES OF BOAT HULLS AND THE LIKE

[76] Inventor: Dwight J. Strong, 523 N. Delaware St., San Mateo, Calif. 94401

[21] Appl. No.: 309,597

[22] Filed: Feb. 8, 1989

[51] Int. Cl.[4] ..... B63B 59/08

[52] U.S. Cl. ..... 114/222; 15/1.7

[58] Field of Search ..... 114/222; 15/1.7

[56] References Cited

U.S. PATENT DOCUMENTS

| | | | |
|---|---|---|---|
| 238,624 | 3/1881 | Westberg | 114/222 |
| 2,243,576 | 5/1941 | Otto | 15/1.7 |
| 3,003,168 | 10/1961 | Shouldice | 15/1.7 |
| 3,010,420 | 11/1961 | Glynn | 114/222 |
| 3,402,413 | 9/1968 | Gibellina | 15/1.7 |
| 4,648,344 | 3/1987 | Burgers et al. | 114/222 |
| 4,776,053 | 10/1988 | Kiraly | 15/1.7 |

FOREIGN PATENT DOCUMENTS

| | | | |
|---|---|---|---|
| 450879 | 7/1936 | United Kingdom | 114/222 |
| 584029 | 1/1947 | United Kingdom | 15/1.7 |
| 2142525 | 1/1985 | United Kingdom | 114/222 |

*Primary Examiner*—Sherman D. Basinger
*Assistant Examiner*—Thomas J. Brahan
*Attorney, Agent, or Firm*—John J. Leavitt

[57] ABSTRACT

Presented is a device for scrubbing submerged surfaces that have become fouled by marine growth or other contaminants. The scrubbing device includes a base member to which may be attached various types of abrading devices and a handle for reciprocating the scrubbing device. A vane pivotally mounted on the base interacts with the water in which the device is submerged, when reciprocated, to impose a component of force on the scrubbing device that drives the scrubbing device against the surface to be scrubbed.

9 Claims, 3 Drawing Sheets

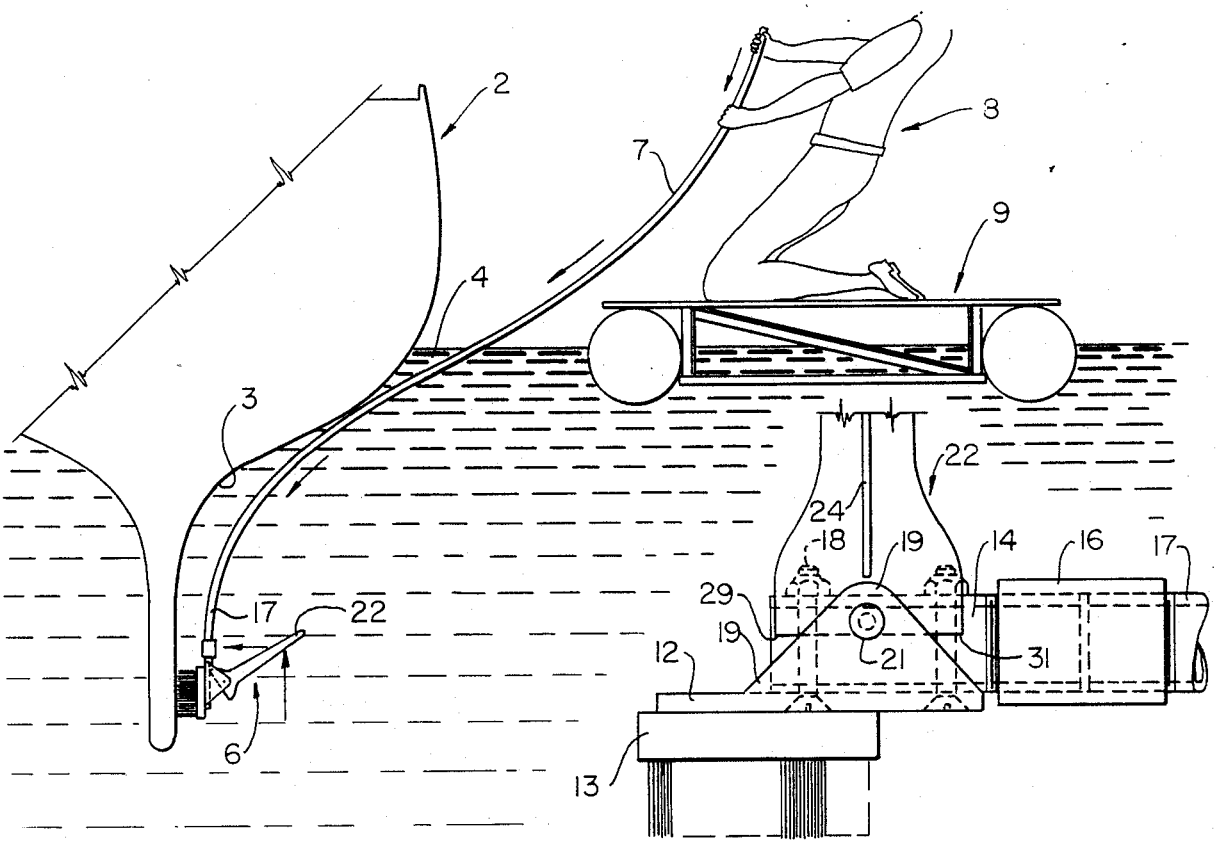
FIG. 1
FIG. 2
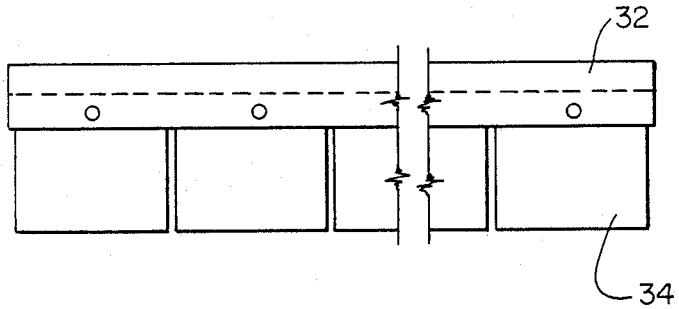
FIG. 3
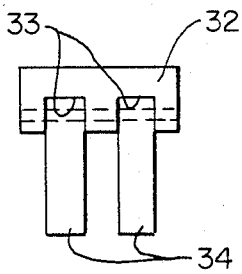
FIG. 4
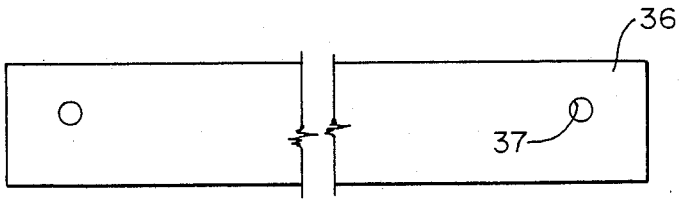
FIG. 5
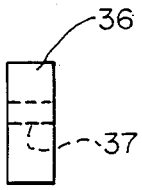
FIG. 6

SCRUBBING DEVICE FOR SUBMERGED SURFACES OF BOAT HULLS AND THE LIKE

BACKGROUND OF THE INVENTION

1. Field of the Invention

This invention relates to scrubbing devices, and particularly to scrubbing devices that are useful for scrubbing surfaces that lie submerged in a body of water.

2. Description of the Prior Art

A search of the prior art has revealed the existence of U.S. Pat. No. 4,648,344 which appears to be the only U.S. patent pertinent to the problem and solution presented herein, but which functions by a different mode utilizing different structure. U.S. Pat. No. 4,648,344 utilizes a flexible sheet of relatively thin material on one side of which is provided a means for scrubbing while on the opposite surface thereof are provided a multiplicity of floatation devices so that when the device is submerged, say, for instance, below a boat hull submerged in the water, the floatation means on the strip function to provide an upward component of force on the strip, causing it to plaster itself against the surface of the boat hull. A handle connected to the elongated sheet may then be manipulated to reciprocate the sheet while in contact with the boat hull.

The problem of removing marine growth from the surfaces of boat hulls has been a problem that has existed for as long as boats have been plying large bodies of salt water. It does not appear to be a problem where boats are utilized in bodies of fresh water.

The problem however is not restricted only to boat hulls in salt water. Rather, the problem includes the accumulation of sediment and scum on the walls of swimming pools and other underwater surfaces. With regard to marine growth on the hulls of recreational boats, such growth can seriously affect the efficiency of the boat hull in the water, and must therefore be removed periodically to use the boat to best advantage. There are various types of marine growth, one form being a type of scum or slime that seems to attach itself to wide expanses of underwater hull surfaces, while other types of marine growth include barnacle-like creatures that attach themselves to the hull and form a protrusion from the outer surface of the boat hull that has a very detrimental effect on the speed that may be achieved by the boat in the water.

It is therefore an object of the present invention to provide a scrubbing device that is effective to remove all types of marine growth that might attach itself to the underwater surface of a boat hull.

Because of the different types of marine growth that attach themselves to a boat hull, it is necessary that a scrubbing device possess the versatility to remove all types of marine growth. Accordingly, another object of the invention is the provision of a scrubbing device that may be quickly and easily converted from a scrubbing device for removing a uniform layer of marine growth to one for removing marine growth such as barnacles.

The most expedient way of cleaning the underside of a boat hull is to haul the boat out of the water so that access can be had to all of the under surfaces of the boat apart from the water in which they are usually submerged. However, hauling a boat out of the water can be an expensive procedure and is to be avoided if possible. Accordingly, still another object of the invention is the provision of a scrubbing device for scrubbing boat hulls that is effective for scrubbing a submerged surface of the boat hull while the person manipulating the scrubbing device is standing or kneeling on a wharf or floatation platform along side the boat.

With some types of pleasure boats, such as motor launches that are essentially flat bottomed boats, to scrub the underside or bottom of the boat while the boat is resting in the water it is necessary that a diver equipped with self contained underwater breathing apparatus (scuba) enter the water and physically scrape the bottom of the boat with an appropriate tool. Accordingly, another object of the present invention is the provision of a scrubbing device for the underside of boats that may be utilized by a diver equipped with scuba.

One of the problems that is frequently encountered with scrubbing devices for scrubbing the underside of boat hulls is the strength and stamina that must be possessed by the person operating the scrubbing device. Many such devices are make-shift and require manipulation by a strong man, accustomed to doing that type work. Accordingly, a still further object of the present invention is the provision of a scrubbing device that may be manipulated by even a small person unaccustomed to manipulating a scrubbing device of any kind.

When a boat hull is submerged and it is attempted to scrub the submerged surface, it is necessary that the scrubbing device be pressed forcefully against the fouled boat surface and manipulated, usually by reciprocation, to abrade the surface to remove the marine growth thereon. The problem lies in the manner and means of applying such force to the scrubbing device while the person manipulating the scrubbing device is standing or kneeling on the dock or wharf. One method of course is to utilize a long, stiff and rigid handle on one end of which is attached the abrading means. Using the long, stiff and rigid handle as a lever, the operator can exert a certain amount of force on the boat hull with the abrading device and when the device is reciprocated, the marine growth will be removed. The difficulty with such a device is that most boat hulls are contoured to provide curved surfaces and the utilization of such a stiff and rigid device does not enable the cleaning of such contoured surfaces. Accordingly, another object of the present invention is the provision of a scrubbing device for contoured boat hulls in which the scrubbing device includes an elongated and resiliently flexible handle that enables the scrubbing device to follow the contoured boat hull.

It is desirable that it not be necessary for the operator by a conscious effort to force or press the abrading device against the boat hull during the scrubbing procedure. It is preferable that the operator exert merely a reciprocating motion to the scrubbing device, with the application force being applied substantially automatically. Accordingly, a still further object of the invention is the provision of a scrubbing device for scrubbing the underwater surfaces of a boat hull from a dock or wharf which when manipulated by axial reciprocating movement of the handle, causes the scrubbing device to be pressed snugly against the contoured boat hull to thus remove whatever marine growth has attached itself to the boat hull.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the scrubbing device for submerged surfaces, such as boat hulls and the like, of the present invention comprises a member adapted to be snugly abutted against the contoured surfaces of the boat hull so as to abrade the boat hull when reciprocated, a handle attached to the abrading member to enable reciprocation thereof, and a vane mounted on the abrading device that interacts with the water in which it is submerged in such a manner that when the abrading device is reciprocated, the interaction of the vane and the body of water in which it is submerged imposes a component of force on the abrading device in a direction to keep it firmly in contact with the boat hull. In one aspect of the invention, the abrading member comprises a base on which a brush having bristles is placed in contact with the marine growth and, upon reciprocation brushes or sweeps the surface of the boat to remove such marine growth. In another aspect of the invention, the base member is provided with a squeegee-like attachment in place of the bristle brush so that the squeegee-like blades may exert a scraping action on the boat hull to remove marine growth of the type that is scummy and which adheres to the boat hull surface over a large area. In a tired aspect of the invention, a relatively rigid bar is attached to the base member and may be manipulated to forcefully knock off firmly attached marine growth such as barnacles without damage to the boat hull.

BRIEF DESCRIPTION OF THE DRAWINGS

FIG. 1 is a perspective view illustrating the manner of use of the preferred embodiment of the invention for scrubbing the submerged surfaces of a boat hull by an operator kneeling on a wharf or float adjacent the boat.

FIG. 2 is a fragmentary end elevational view of the scrubbing device, portions being broken away to reduce the size of the view. The abrading member in this view is represented as being a stiff bristle brush.

FIG. 3 is a front elevational view of a squeegee-like abrading tool adapted to be attached to the scrubbing device in place of the stiff bristle brush illustrated in FIG. 2.

FIG. 4 is an end elevational view of the squeegee-like abrading device of FIG. 3.

FIG. 5 is a bottom plan view of a third abrading device adapted to be attached to the scrubbing device in place of the stiff bristle brush and useful for dislodging from the boat surface tightly adherent marine growth such as barnacles. The abrading members illustrated in FIGS. 3 and 5 are shown apart from the scrubbing device base and handle as illustrated in FIGS. 1 and 2.

DESCRIPTION OF THE PREFERRED EMBODIMENT

Figure 8:
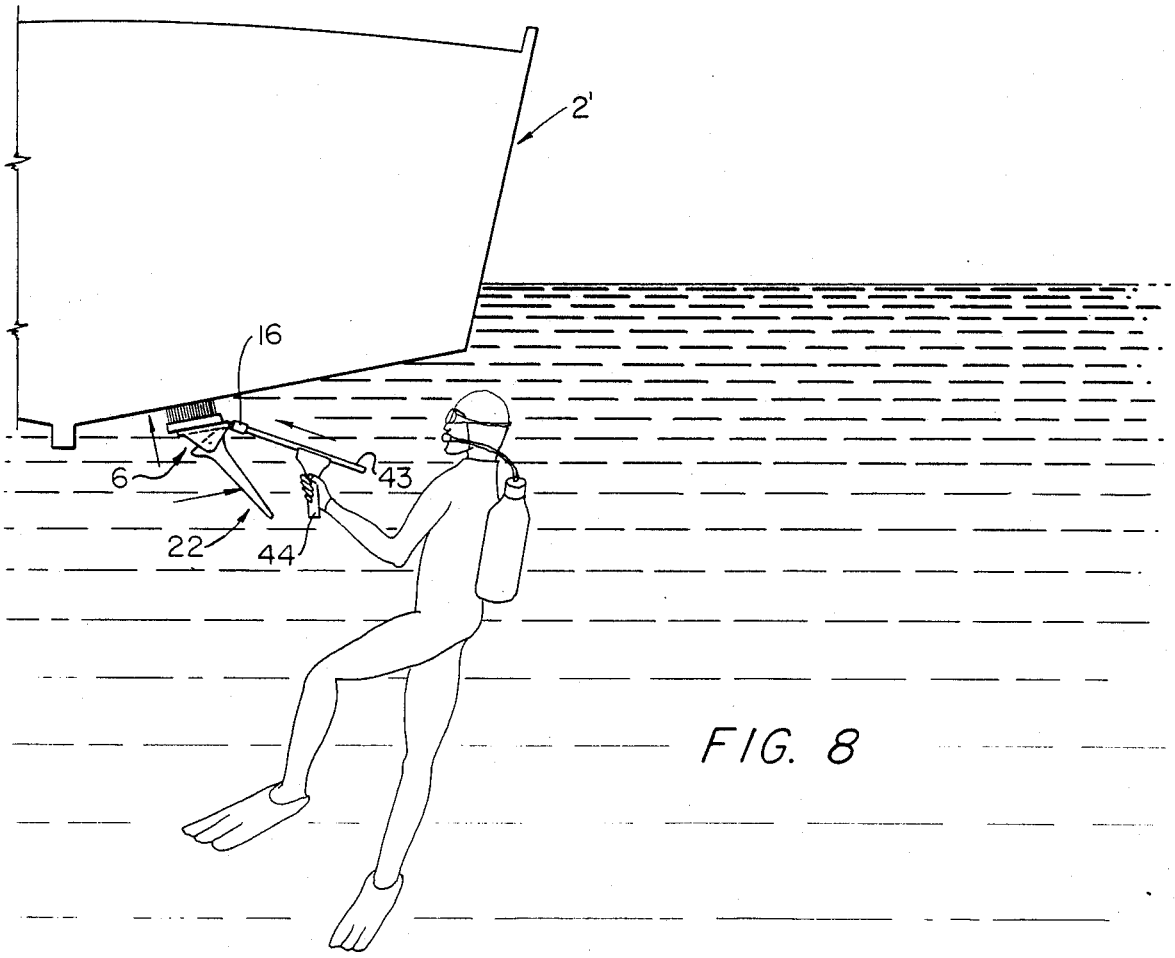
FIG. 8 is an elevational view illustrating the manner of use of the scrubbing device of the invention by a diver equipped with scuba and utilizing the scrubbing device of the invention to scrub the underside of a power boat hull.

In terms of greater detail, the scrubbing device of the invention is particularly applicable for use in scrubbing the submerged surfaces of a boat hull, such as a sailboat that has contoured undersurfaces, but may also be utilized to clean the bottom surface of a powerboat, as illustrated in FIG. 8, and, as will hereinafter be explained, may also be used to good advantage to clean the submerged surfaces of a swimming pool. While I have chosen to illustrate the invention for use in connection with the scrubbing of the submerged surfaces of a sailboat and powerboat, it will be clear that the scrubbing device may be utilized in other environments.

Referring to FIG. 1, it will there be seen that a boat hull is designated generally by the numeral 2, and is provided with contoured surfaces 3 that lie submerged in a body of water 4. It is common knowledge that these submerged surfaces are attractive to various types of marine growth, and that over time, such marine growth achieves an appreciable thickness on the submerged surfaces, adding weight to the boat, and adding a roughness to the surface that has an effect on the frictional relationship between the boat hull and the body of water through which it passes when under way.

Marine growth, or fouling, customarily clings to all submerged surfaces of the boat hull in the nature of a "blanket" of uniform thickness and of a soft and squishy yet nevertheless adherent layer. Interspersed with such "blanket" layer of marine growth may be encountered other types of marine growth such as barnacles, which are manifested as nodule-type projections adherent to the submerged surfaces of the boat hull, and in some cases also covered by the "blanket" of uniform thickness of marine growth or fouling that attaches itself to the boat hull.

Figure 7:
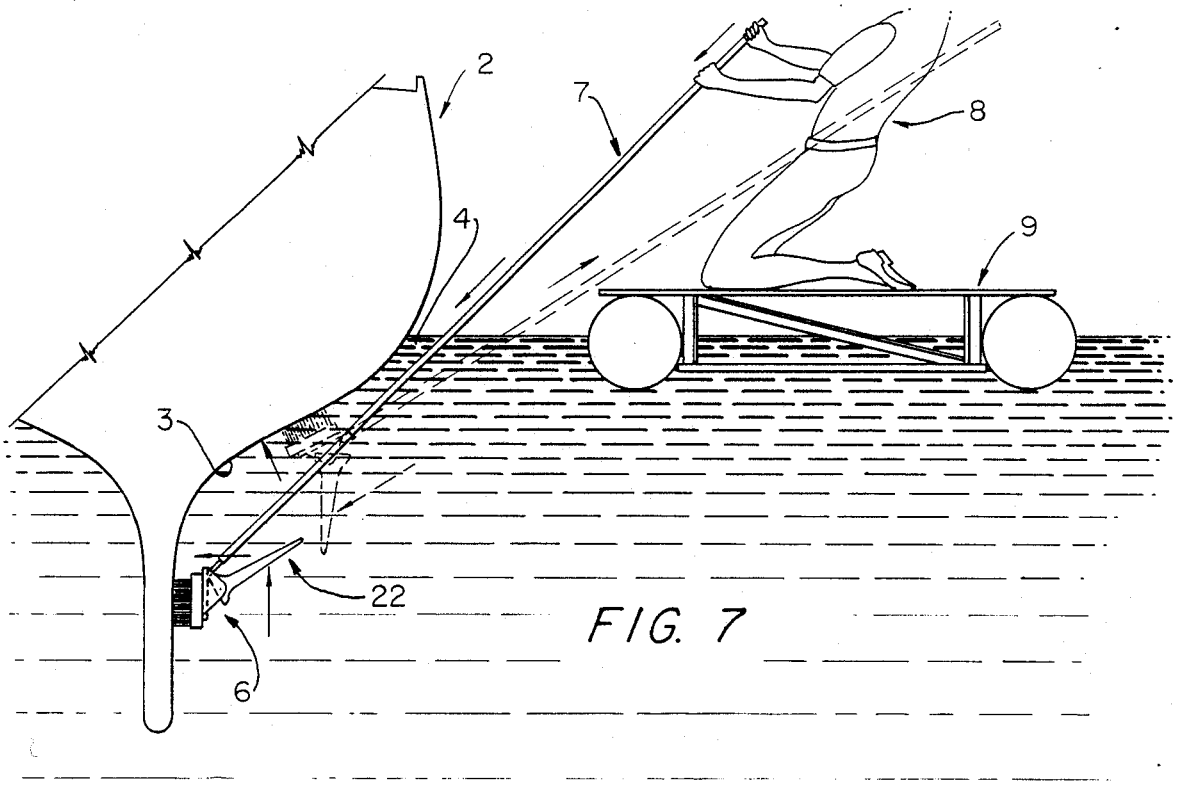
FIG. 7 is a view similar to FIG. 1, but illustrating a pivotal interconnection between the handle and the scrubbing device, all other features being identical to the embodiment illustrated in FIGS. 1 and 2.

To remove such marine growth, my invention provides a scrubbing device designated generally by the numeral 6, and including a handle 7 that is attached at one end to the scrubbing device, and which is adapted to be manipulated by its other end by an operator designated generally by the numeral 8. As illustrated in FIGS. 1 and 7, it is preferable that the operator be able to support himself either standing or kneeling on an appropriate flotation platform 9 alongside the boat.

Referring specifically to the scrubbing device designated generally by the numeral 6, it will be seen by reference to FIG. 2 that the scrubbing device comprises a base plate 12 to which is removably secured an abrading member 13, here illustrated as a stiff bristle brush removably attached to the underside of the base plate 12 by appropriate screws (not shown) passing downwardly through the base plate generally along a median plane that includes the longitudinal axis of the brush. In this embodiment, the base 12 also serves to mount an elongated threaded pipe nipple 14 to which is threadably engaged a sleeve union 16 adapted to receive the distal end 17 of the handle 7. The elongated and threaded nipple is secured to the base plate 12 as shown by a pair of appropriate cap screws 18. The base plate 12 is conveniently elongated, having a length approximately three times its width. I have found a convenient size to be a mounting plate 9" long and 3" wide.

Mounted on the base plate are a plurality of perpendicularly extending pairs of spaced bearing plates or trunnion members 19 arranged in multiple pairs adjacent one long edge of the base plate and extending generally transversely across the base plate. The multiple pairs of spaced bearing plates or trunnions are provided with aligned apertures 20 adjacent their upper ends remote from the base plate, and are adapted to receive pivot pins 21 that serve to pivotally support on the mounting base 12 a force-exerting vane designated generally by the numeral 22.

Figure 9:
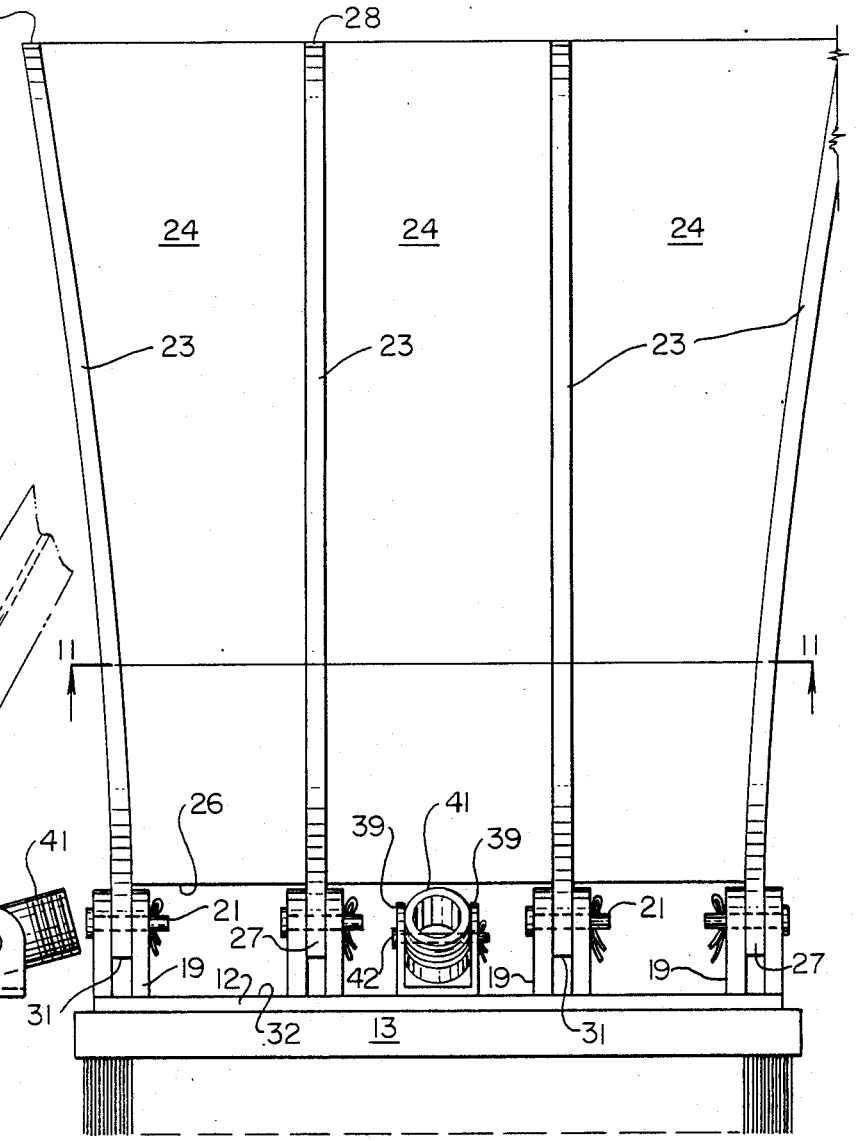
FIG. 9 is a rear elevational view of the scrubbing device illustrated in FIGS. 7 and 8 and equipped with a pivotal handle.
Figure 11:
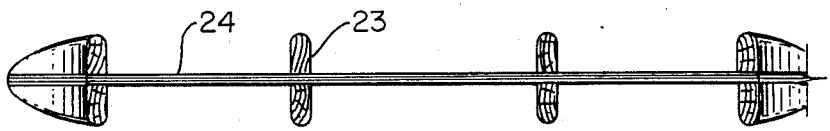
FIG. 11 is a horizontal cross-sectional view taken in the plane indicated by the line 11—11 in FIG. 9.

The force-exerting vane is constructed of laterally spaced rib members 23, the rib members being spaced apart as illustrated in FIG. 9, with the laterally outboard ribs 23 being curved laterally outwardly toward the free end of the vane to provide a greater width of the force-exerting vane at its end remote from the base plate than its width where it is pivotally mounted to the base plate. The space between the pairs of ribs 23 is filled by a thin web 24 so that the vane may function in the manner of a paddle to exert force against a body of water when the scrubbing device is drawn or pushed therethrough. At its end next adjacent the mounting plate 12, the webs terminate in a lower edge 26 that is spaced above the bearing plate 19, while the lower end portions 27 of the ribs 23 extend below the lower edge 26 of the web, and are accommodated pivotally between the pairs of upright bearing plates or trunnion plates 19. The lower end portions 27 of the ribs are bored transversally coincident with a median plane, i.e., equidistant from the opposite edges of the ribs, so that the vane may be pivotally mounted on the bearing plates by insertion of the pins 21 through the aligned apertures in the bearing plates and the aligned apertures in the lower end portions of the ribs.

Figure 10:
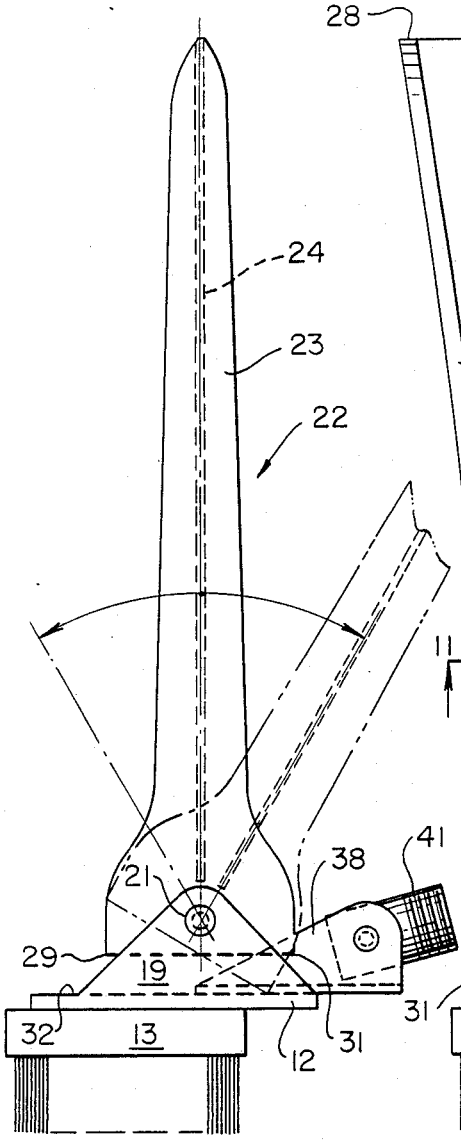
FIG. 10 is an end elevational view of the scrubbing device illustrated in FIG. 9, the range of pivotal motion of the force-exerting vane being illustrated by the arcuate arrow.

With reference to FIGS. 2 and 10, it should be noted that each of the ribs 23 is tapered from its outer end 28 so that it increases in width toward the mounting plate 12, and each rib merges smoothly with the end portion 27 which is significantly wider than the widest portion of the remainder of the rib so as to provide opposed corners 29 and 31 defining the lower end of each rib. The importance of this dimensional relationship is illustrated in FIG. 10, where it is shown that the corners 29 and 31 constitute stops or abutments that come into physical contact with the top surface 32 of the base plate 12 when the vane is pivoted to its extreme positions on either side of the median position illustrated in FIG. 10. It will of course be understood that in use the vane occupies this median position only momentarily while moving from one extreme position to the other as will hereinafter be explained. Additionally, while I have illustrated all of the ribs as having a widened lower end portion 27 so as to provide the stop corners 29 and 31, it will of course be appreciated that functionally other stop means may be employed without departing from the intent and spirit of the invention. Thus, perhaps only one rib need be provided with the widened lower end portion, or the two outer ribs that define the lateral limits of the vane, or perhaps the two intermediate ribs may be the only ones provided with a widened lower end portion so as to provide the abutment corners 29 and 31 that function to limit the extent of displacement of the vane between two well defined extremes about 60 degrees apart.

In FIGS. 1, 2, 7, 8, 9 and 10, the device is shown equipped with a stiff bristle brush 13 which is very effective to sweep from the submerged surface 3 of the boat much of the "blanket" like marine growth that adheres to such surface. There are occasions, however, when it is desirable that the stiff bristled brush 13 be replaced with a structure such as that illustrated in FIGS. 3 and 4, or the structure illustrated in FIGS. 5 and 6.

Referring to the structure illustrated in FIGS. 3 and 4, there is there shown an elongated bar 32 adapted to be detachably secured to the underside of the base plate 12 in the same manner that the bristle brush 13 is detachably secured thereto, namely, by the passage of appropriate screws through the base plate 12 and into the underlying structure, whether it be the bristle brush 13, or the structures illustrated in FIGS. 3 and 5. The elongated bar 32 may conveniently be fabricated from any suitable material, such as wood, plastic or metal, and is provided with two elongated and parallel grooves 3 within which are secured a multiplicity of juxtaposed resiliently flexible blades 34, preferably fabricated from a neoprene-type rubber, and adapted to be swept over the submerged surface 3 of the boat by the scrubbing device in the same manner that the bristle brush 13 is swept over the surface. The effect of the flexibly resilient blades 34 is to function as a squeegee, resiliently abutting the adjacent surfaces of the boat and thereby sweeping before it all marine growth that might be attached to the surface. It is frequently desirable to utilize this tool following an initial brushing with the bristle brush 13 so as to clean up all vestiges of marine growth that might have been left behind by the bristle brush.

Referring to the structure in FIGS. 5 and 6, I have found through experience that barnacles attach themselves so tenaciously to a submerged surface of a boat that it is most difficult to remove them with a bristle brush or a resiliently flexible blade such as that illustrated in FIGS. 3 and 4. I have found that a solid elongated bar designated generally by the numeral 36 and illustrated in FIGS. 5 and 6, may be attached to the underside of the base plate 12 in place of the bristle brush 13 or the squeegee structure of FIG. 3, and is very effective when drawn over the surface to sharply abut the barnacles thereon and to forcefully dislodge them from the surface to which they are attached. It is preferable that this elongated bar 36 be provided with apertures 37 as indicated through which appropriate screws (not shown) may extend to detachably secre the bar to the base plate 12. I have found that when the bar 36 is fabricated from laminated fiberglass compressed with an appropriate adhesive between the laminations that the edges of the bar remain relatively sharp so as to effectively dislodge the adherent barnacles.

In FIGS. 1 and 2, the scrubbing device is shown equipped with the nipple 14 that is detachably secured to the base plate 12 and adapted to be engaged by the sleeve 16 and the handle 7. I have found that in certain instances it is helpful to provide a pivotal union between the handle 7 and the base plate 12, and have accordingly illustrated such a construction in the embodiment of the invention illustrated in FIGS. 7 through 10, inclusive. As shown in FIG. 10, in this embodiment, there is mounted on the top surface 32 of the base plate 12 a generally U-shaped bracket 38 having flanges 39 that extend upwardly from the base plate to provide a pivot point for the connector member 41. Preferably, the connector member is provided with appropriate threads to which may be detachably secured a threaded sleeve such as the sleeve 16 in FIG. 2. The connector member is pivoted to the flanges 39 by an appropriate pin 42 as shown. Such a pivotal connection between the handle 7 and the scrubbing device enables the use of a handle 7 that is not quite so flexible as the handle illustrated in FIG. 1, the pivotal union substituting for some of the flexibility of the handle shown in FIG. 1.

The underside of power boats present a special problem with respect to cleaning the submerged under surfaces of the boat from a dock or from a floatation platform for the reason that it is difficult to secure access to the bottom of such a boat. As illustrated in FIG. 8, one method of cleaning the bottom of such a boat is to send a diver equipped with scuba into the water so that he may work beneath the boat to abrade the bottom and thus remove marine growth. The subject matter of this invention is particularly appropriate for such use as illustrated, the handle 7 illustrated in FIGS. 1 and 7 being substituted by a much shorter handle 43 having a pistol grip 44 that may be easily manipulated by the diver. The shorter handle 43 is attached to the sleeve 16 in the same manner that the handle 7 is connected thereto.

As discussed above, one of the problems that is posed by the necessity of scrubbing the underside or submerged surfaces of a boat that is covered with marine growth, is the ability to press the abrading tool tightly against the submerged surface while the abrading tool is reciprocated, either from beneath the boat as in FIG. 8, or from a floatation platform as illustrated in FIGS. 1 and 7. Referring to FIG. 1, it will be seen that when the operator 8 pushes downwardly on the handle 7 in the direction of the arrows, it causes the scrubbing device 6 to move downwardly and in so moving, the vane 22 is caused by the pressure of water beneath it to pivot upwardly as illustrated by the vertical arrow beneath the vane 22. Stated another way, the body of water in which the vane is immersed exerts an upwardly directed component of force in the direction of the arrow below the vane 22, and since the vane is tilted upwardly, there is also imposed a horizontal component of force in the direction of the submerged surface of the boat. This is illustrated by the horizontal arrow in FIG. 1. Accordingly, all that is required of the operator is that he or she reciprocate the handle 7 along its elongated axis so as to cause the grubbing device to reciprocate below the water, such reciprocation causing shifting of the vane 22 between the two extremes discussed above. Thus, when the scrubbing device is pulled toward the operator as illustrated in broken lines in FIG. 7, the force of the water on the vane causes the vane to pivot in the opposite direction, and there is imposed on the scrubbing device an upwardly directed component of force that keeps the scrubbing device in contact with the surface to be abraded by the scrub brush, or the resiliently flexible blades 34 or the bar 36 illustrated in FIG. 5. This same phenomenon is illustrated in FIG. 8 where the diver is below the water and is operating with scuba. When he pushes on the handle 43 in the direction of the arrow, the vane 22 is pivoted to the right as indicated by the arrow by the component of force exerted by the water through which the vane must move. In so doing, there is a vertical component of force exerted against the scrubbing device, also as indicated by the arrow, so that the bristle brush remains in contact with the surface to be abraded or swept merely by the action of reciprocating the structure in the water in association with the surface to be abraded.

Having thus described the invention, what is believed to be new and novel and sought to be protected by letters patent of the U.S. is as follows:

I claim:

1. A device for cleaning surfaces submerged below a body of water, comprising;

(a) a non-buoyant base member;

(b) means detachably secured on the non-buoyant base member for abrading the surface to be cleaned;

(c) a handle relatively stiff in a longitudinal direction and connected to said non-buoyant base member and adapted for reciprocation by an operator manipulating the device to alternately impose tension and compression on the handle to effect reciprocation of said non-buoyant base member and said means thereon for abrading the surface to be cleaned;

(d) a vane pivotally mounted by one end on the non-buoyant base member on the side thereof opposite said means for abrading and operative to impose a force on said means for abrading in the direction of the surface to be cleaned when said device is reciprocated in the water; and (e) said handle comprising an elongated member relatively flexible in a transverse direction and detachably secured at one end to said base member and of sufficient length to enable manipulation of the relatively stiff handle from the other end thereof from outside the body of water.

2. The combination according to claim 1, in which said means detachably secured on the non-buoyant base for abrading the surface to be cleaned comprises a bristle brush.

3. The combination according to claim 1, in which said means detachably secured on the non-buoyant base for abrading the surface to be cleaned comprises a resiliently flexible blade detachably secured to said base member.

4. The combination according to claim 1, in which said means detachably secured on the non-buoyant base for abrading the surface to be cleaned comprises a rigid bar detachably secured to said base member, said rigid bar having sharp edges adapted to scrape against the surface to be cleaned.

5. The combination according to claim 1, in which said handle is detachably and pivotally connected to said base member.

6. The combination according to claim 1, in which said non-buoyant base member is elongated and adapted to be reciprocated in a direction perpendicular to its long dimension, trunnion means on said base member at opposite ends thereof, sand said vane operative to exert a force on said abrading means in a direction toward the surface to be cleaned is pivotally mounted by one of its ends on said trunnion means.

7. The combination according to claim 1, in which said vane for exerting a force on said abrading means in the direction of said surface to be cleaned is pivotally mounted on the non-buoyant base member for pivotal movement between two extremes whereby movement of the base member in the water in a given direction effects limited pivotal displacement of the vane in the opposite direction by the force of water acting against the vane whereby a component of force is exerted on said base member in a direction perpendicular to the direction of force exerted on the vane to effect its displacement.

8. The combination according to claim 7, in which stop means are provided on said vane associated with the pivoted end thereof to limit displacement thereof between said two extremes.

9. The combination according to claim 7, in which laterally spaced ribs are provided on opposite sides of said vane extending longitudinally of said vane from the pivoted end thereof to the opposite end for directing the flow of water from the pivoted base end of the vane to its outer free end.

* * * * *